United States Patent [19]

Wilhelm et al.

[11] 4,365,623

[45] Dec. 28, 1982

[54] APPARATUS TO EXERT TRACTION IN TRACTION THERAPY

[75] Inventors: Tru G. Wilhelm, La Quinta; Heinz C. Ross, Fallbrook; Bradley T. Wilhelm, Murrietta Hot Springs, all of Calif.

[73] Assignee: Tru-Eze Manufacturing Co., Temecula, Calif.

[21] Appl. No.: 127,874

[22] Filed: Mar. 6, 1980

[51] Int. Cl.[3] ..... A61H 1/02

[52] U.S. Cl. ..... 128/75

[58] Field of Search ..... 128/75, 84 R, 84 B, 128/84 C; 340/668; 254/272, 355

[56] References Cited

U.S. PATENT DOCUMENTS

| | | | |
|---|---|---|---|
| 2,280,105 | 4/1942 | Sturges . | |
| 2,365,709 | 12/1944 | Lilja . | |
| 2,445,228 | 7/1948 | Le Tourneau . | |
| 2,940,441 | 6/1960 | Demarest | 128/75 |
| 2,940,442 | 6/1960 | Wilhelm | 128/75 |
| 2,995,968 | 8/1961 | Tomberg . | |
| 3,016,754 | 1/1962 | Corey . | |
| 3,168,094 | 2/1965 | Siltamaki | 128/75 |
| 3,710,787 | 1/1973 | Rabjohn | 128/75 |
| 3,786,803 | 1/1974 | Petulla et al. | 128/75 |
| 3,835,847 | 9/1974 | Smith | 128/75 |
| 3,848,467 | 11/1974 | Flavell | 272/116 |
| 4,258,707 | 3/1981 | Lettinga | 128/75 |
| 4,266,537 | 5/1981 | Bonin, Jr. et al. | 128/75 |

FOREIGN PATENT DOCUMENTS

| | | | |
|---|---|---|---|
| 7611461 | 4/1978 | Netherlands | 128/75 |
| 2001185 | 1/1979 | United Kingdom | 128/75 |

OTHER PUBLICATIONS

TX Traction Equipment, Adapta Treatment Tables, Chattanooga Corp., pp. 1 & 4.

*Primary Examiner*—Richard J. Apley
*Assistant Examiner*—T. J. Wallen
*Attorney, Agent, or Firm*—Donald D. Mon

[57] ABSTRACT

Therapeutic traction apparatus for exerting sequential changes in tension pull on a flexible line which is attachable to a traction harness. The apparatus is responsive to tension which exists in the line. A timer can be provided to establish pause and dwell times, and a programmed control can be provided to establish various tension levels and types of sequences.

20 Claims, 10 Drawing Figures

20
21
30
33
52
47
23
51
112
113
114
79
101
77
73
50
45
49
44
42
43
46
53
107
109
108b
103
110
108a
122
48
108
100
102
106
111
121
103
105
120
22

30
20
33
24
31
32
52
78
80
74
81
83
84
82
71
35
36
40
85
86
22
PROGRAM
COMPARATOR
87
97
91
102
92
60
96
OVERRIDE
94
95
61
62
63
SWITCH
64
65

APPARATUS TO EXERT TRACTION IN TRACTION THERAPY

FIELD OF THE INVENTION

This invention relates to therapeutic traction apparatus of the type which exerts a tension pull on a flexible line. The flexible line is customarily connected to a traction harness such as a head harness or a chin harness worn by the patient while reclining on a treatment table.

BACKGROUND OF THE INVENTION

Traction therapy is a process wherein a patient's spine is placed in tension in order to relieve structural anomalies. Traction apparatus per se is well known for example from Wilhelm U.S. Pat. No. 2,940,442 issued June 14, 1960 and Siltamaki U.S. Pat. No. 3,168,094, issued Feb. 2, 1965. In such a system, it is customary for the patient to wear a head or a chin harness, recline on the treatment table, and then a traction line is attached to the harness, after which a tension pull will be exerted on the harness through the flexible line. Often it is desirable to apply tensile loads which are quite high, sometimes as high as 200 pounds. Some of these loads can sound quite frightening to the patient when he first hears of them, and of course they cannot generally be applied abruptly. Instead they should be applied in a carefully controlled manner and under the most relaxing and reassuring of circumstances.

It is best practice for the device to operate as quietly as possible, in order not to distract the patient, because the rooms in which traction processes are carried out are generally very quiet. Sharp clicks can startle the patient and prevent the desired relaxation. Also it is desirable to be able to increase or decrease the tensile loads in increments to permit the patient to develop a tolerance to the desirable heavier loads, both over a long period of time, and also during the course of a treatment which might last as long as an hour.

It is also a desirable feature that there be safety provisions which will prevent exertion of excessive force, exertion of force in excess of a pre-selected value, or the sudden release of line tension.

It is desirable that, when programming apparatus to develop tension, there be a coincidence between the desired and the attained values. There exist in the prior art some devices which are springily responsive to the force on the flexible line, examples being the said Wilhelm and Siltamaki patents. However, these devices are not adapted for carrying out a variety of programmed sequences.

It is desirable to be able to program the apparatus for a wide range of programs in order to provide the therapist with a broad range of options for treating the patient. In Petulla U.S. Pat. No. 3,786,803, issued Jan. 22, 1974, ratchet means is provided on the device of the said Siltamaki patent in order to increase the tension by some given increment at the end of each cycle. However, this ratchet is a noisy device, and is not functionally adaptable other than to provide a stepwise increase in tension after a previous tension level has been attained. Traction equipment is costly, and it is a very useful objective for one machine to be programmable to a wide variety of sequences and loads, and even to be adaptable to new and different programming as new and different sequences may be conceived in the future.

It is an object of this invention to provide a therapeutic apparatus which is programmable to provide a large number of programmed sequences, and which operates reliably and silently to provide a tension force in the flexible line which closely corresponds to the programmed value.

It is another object of this invention to provide a tension sensing means for such apparatus which is compact, convenient to use, and readily adaptable to use in programmed apparatus.

This invention includes a flexible line attachable to a harness, and drive means to which the line is engaged for pulling it in and paying it out. A motor is operatively engaged to the drive means, and a motor control means is operatively interposed between the motor and a source of energy for driving the motor. The motor control means has a first and a second control condition for respectively causing the motor to pull in or pay out the line, and a third control condition where it does neither. Tension sensing means is responsive to tension exerted on the line and is adapted to provide a signal which is proportional to the value of the tension.

Program means comprises circuitry defining a predetermined sequence of motor operations to establish a pre-determined sequence of tensions on the line. The program means is operationally coupled to the tension sensing means and to the motor control means to cause the motor control means sequentially to assume appropriate ones of its control conditions so as to attain the pre-determined sequence of tensions in the line.

According to a preferred but optional feature of the invention, the motor control means includes a comparator means for comparing the signal from the tension sensing means to a signal representative of a value selected by a sequence means. The motor control means assumes a respective condition which causes the motor to operate or not to operate to attain the selected value.

According to another preferred but optional feature of the invention, the tension sensing means includes a compression spring responsive to line tension, whose length is proportional to the line tension, and which can be used as a means for generating a signal proportional to the line tension.

BRIEF DESCRIPTION OF THE DRAWINGS

The above and other features of this invention will be fully understood from the following detailed description of the best mode known to applicants and the accompanying drawings, in which.

DETAILED DESCRIPTION OF THE INVENTION

Figure 1:
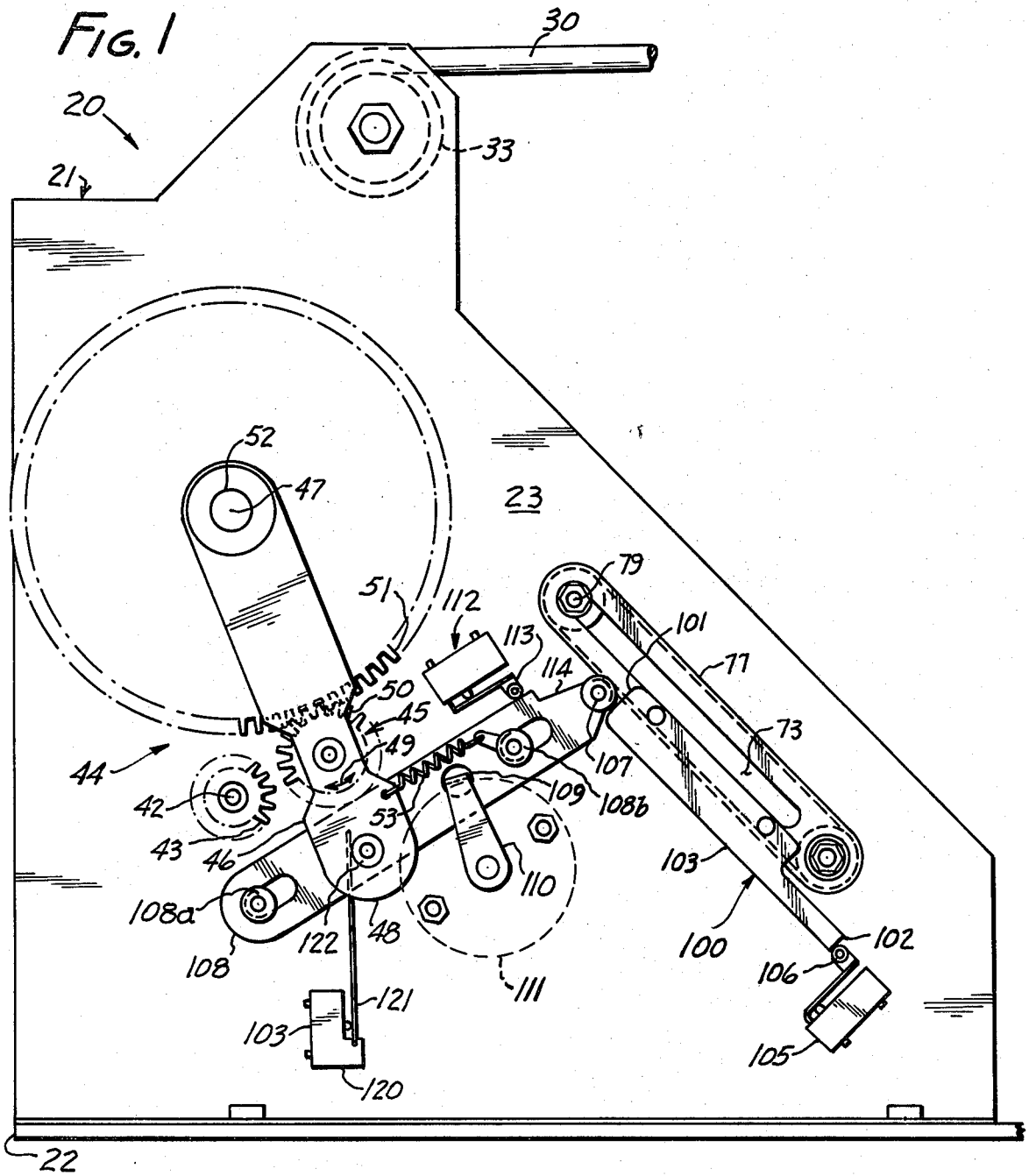
FIG. 1 is a side elevation of a therapeutic apparatus according to the invention.
Figure 2:
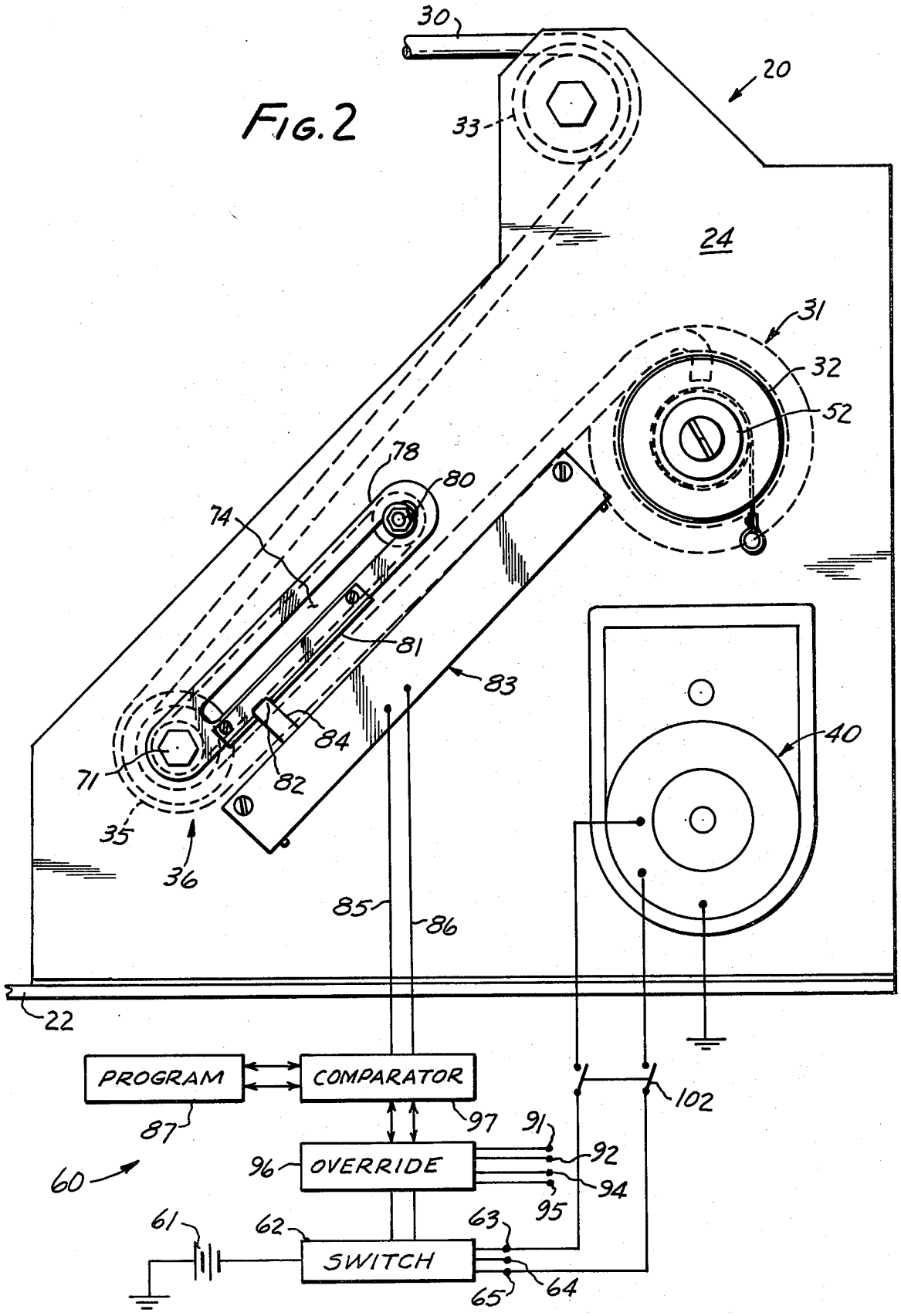
FIG. 2 is a plan view showing the reverse side of FIG. 1.
Figure 3:
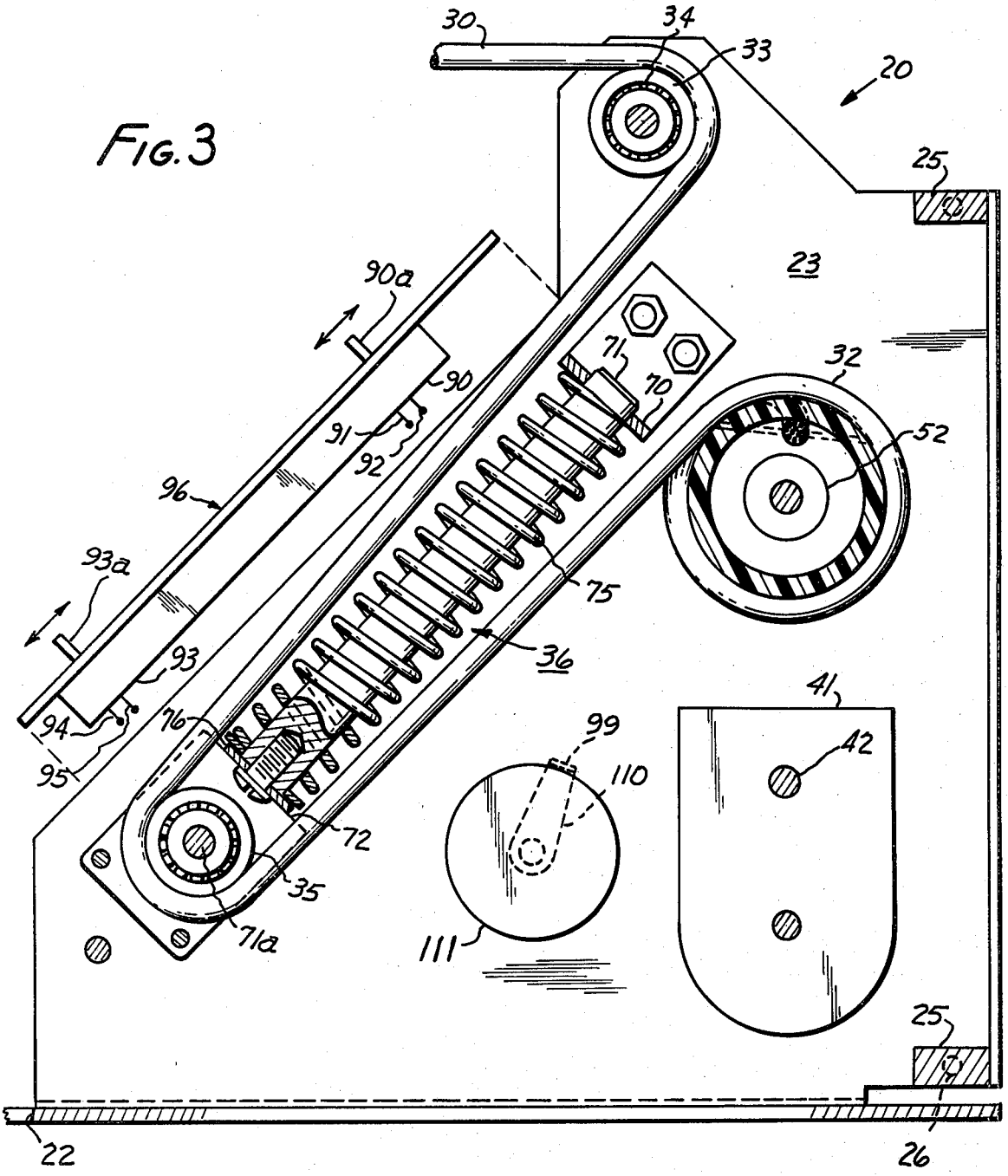
FIG. 3 is a cross-section taken medially of FIGS. 1 and 2.

The mechanical portion of therapeutic traction apparatus 20 according to the invention is shown in FIGS. 1, 2, and 3. It includes a frame 21 having a base plate 22 and two side plates 23, 24. The side plates are appropriately spaced apart by spacers 25, and are held together by fasteners 26. The purpose of this apparatus is to exert tension on a flexible line 30. The line may be a cord, braided rope, or the like, adapted to be connected to a head or chin harness (not shown). The actual pulling in and paying out of the line is accomplished by a drive means 31 which includes a reel 32 around which the line is wrapped. Clockwise rotation of the reel in FIGS. 2 and 3 will result in pulling in on the line i.e., to increase the tension, and counterclockwise rotation will pay out the line i.e., to reduce the tension.

The line is first bent around idler 33 which is supported on bearing 34 between the two side plates. It is then bent around a second idler 35 that forms part of a tension sensing means 36 yet to be described.

From the second idler 35, the line is wrapped upon reel 32. Tension can be established in the line by appropriate rotation of the reel in one or the other of its directions, or by not turning the real when the tension is correct.

For purposes of changing the tension on the line i.e. of pulling it in or paying it out, a bi-directional motor 40 is mounted to side plate 24. The motor directly drives a gear reduction 41, whose output shaft 42 is journaled in the two side plates, and which supports on its end beyond side plates 23 a spur type drive gear 43.

The drive means and the motor are functionally connected by a transmission 44 between the drive gear 43 and the reel. This transmission includes a clutch 45. Clutch 45 includes a support plate 46 that is pivotally mounted to side plate 23 so that its free end 48 can move back and forth in an arc shown by arrow 49. Support plate 46 carries an engagement gear 50 adapted to make engagement with drive gear 43 when the support plate is pivoted toward it, or to stand out of mesh with it when it is pivoted to its other extreme. A reducer gear 51 is pinned to a drive shaft 52. Drive shaft 52 serves as a pivot for support plate 46, plate 46 being journaled on it.

The speed of the motor is reduced first by the gear reduction, and then by the transmission. The drive shaft, which is directly pinned to the reel, will turn at a suitably slow angular velocity. The transmission shown is a simple one, and it will be understood that any other suitable clutch and gear reducing system may be used instead. The one illustrated is elegantly simple and rugged, which is desirable in this type of equipment. A bias spring 53 biases the clutch toward its disengaged condition.

It will be seen that the motor can drive the reel in its two rotational directions depending on the switch connection made to the motor, or in neither direction should there be no connection made. In order to operate the motor, motor control means 60 is interposed between the motor and a source 61 of energy which is schematically shown as a battery, although it will be understood that a power supply connected to a conventional house electrical circuit will usually be utilized.

The motor control means includes a switch 62 which is schematically shown as a three pole, three position switch. It includes terminals 63, 64 and 65. Terminal 64 is a null terminal, at which the switch function is neutral and does not cause the motor to operate in either direction. Terminal 63 is respective to a first direction such as a "pulling in" direction of rotation, and terminal 65 is respective to a second direction such as a "paying out" direction of rotation. It is an object of the remainder of the apparatus yet to be described to control the switch to establish programmable sequences of attained tensions, and to provide for certain safety features.

Tension sensing means 36 is best shown in FIGS. 2 and 3. In FIG. 3, an anchor flange 70 is shown rigidly mounted to, and supported between, the two side plates. A shaft 71 is axially slidably guided in a passage through flange 70. At its lower end it mounts a cross-shaft **71*a* which rotatably supports idler 35 inside a fork 72, that is attached to shaft 71 and mounts cross-shaft 71*a*. Cross-shaft 71*a* is slidably disposed in slots 73, 74 in side plates 23, 24 respectively. These slots are parallel to and opposite from one another. A coil spring 75 is placed in compression between a washer 76 backed up by fork 72, and by anchor flange 70. The spring thereby biases the bearing fork, cross-shaft 71*a*, and idler 35 downwardly and to the left in FIG. 3. Increasing tension on the line will pull shafts 71 and 71*a* upwardly and to the right so as to compress the spring. It is evident that the attained length of the spring will be proportional to the force exerted through cross-shaft 71*a***.

Slide plates 77, 78 are mounted adjacent to side plates 23 and 24 and are pinned to cross-shaft **71*a*. They include slots which surround and are guided by guide pin 80 that is fixed to the side plates. This provides a stable mounting for the lower end of the spring, and for idler 33. It is therefore movable in the general direction of the orientation of slots 73 and 74**.

Slide plate 78 has a flange 81 with a notch 82 in it. A potentiometer 83 or other variable resistance or variable voltage device is mounted to the side plate 24, and includes a finger 84 engagable in notch 82. Accordingly, when shaft **71*a* moves in its slot, flange 84 is also moved and shifts finger 84 along with it. This adjusts potentiometer 83 in accordance with the tension actually exerted in the line. The potentiometer thereby becomes a source for a signal proportional to tension in the line. The potentiometer has a pair of signal lines 85, 86**, to conduct the signal.

A manually adjustable maximum tension limiter 90 (FIG. 3) has signal lines 91, 92. A minimum tension limiter 93 has signal lines 94, 95. These limiters can be sliding wire type variable resistance devices adapted to produce a signal respective to a preset maximum or minimum tension pull. They are equipped with manually-settable means **90*a* and 93*a* to adjust them. They are not directly responsive to the tension exerted in the system but are adjustable to provide a signal proportional to a desired maximum or minimum tension pull to be exerted on the line in the course of the treatment. These two limiters comprise part of the "over ride" means 96 shown in FIG. 2. They are connected in an operative manner with a comparator 97 which receives signals from signal lines 85 and 86. When the operative signal to the switch from the comparator falls within the limits determined by the override means, then the switch can be actuated by the comparator. The comparator receives instructions to be compared to the actual force exerted by the device from program means 87** which will later be described.

Control and safety means are provided on side plate 23 to assure against certain inadvertencies (see FIG. 1). To slide plate 77 there is attached a cam 100 which has a leading end 101, a trailing end 102, and a latch edge 103. Latch edge 103 extends parallel to the direction of motion of the slide plate. A first sensing switch 105 is positioned with its actuator 106 where it will have a first switching condition caused by contact with trailing end 102 of the cam when tension is relieved on the flexible line so that the spring can be fully extended. This indicates that tension is off the line, and will enable events to occur which are permissible only when tension is off the line.

At the illustrated, tension-off, time, leading end 101 is spaced from a cam follower 107 so that axial movement of the cam will be prevented by the cam follower unless the cam follower is retracted. The cam follower is mounted to an actuator plate 108 that is slidable in a direction lateral to the direction of motion of the cam. Plate 108 is rotatably pinned to support plate 46 near its free end so as to be moved back and forth along with that plate. It is guided by two pin-slot devices 108*a*, 108*b* which enable it to move axially, with tolerance to accommodate some small angular movements caused by the arcuate motion of support plate 46. More particularly, plate 108 receives a tang 109 from an actuator arm 110 which is rotatably actuated by a rotary solenoid 111. Energizing the solenoid will cause rotation of actuator arm 110 and rotate the support plate to cause the clutch to become engaged by meshing gears 43 and 50, thereby linking the drive shaft 42 to gear 51.

As it does so, it pulls can follower 107 out of the path of leading end 101 of cam 100, and permits the cam to pass beyond it when tension is applied to the line. Now, and of utmost importance, unless tension is totally relieved on the line, latch edge 103 will prevent cam follower 107 from moving to the clutch-disengaging position shown in FIG. 1, and instead it will mechanically hold the clutch in its latched condition. Accordingly once the clutch has been engaged and sufficient tension has been applied to the line to bring the latch edge up past the follower, the line cannot be released to spin freely from the motor, until and unless the tension on the line has been reduced sufficiently to permit the cam follower to clear the leading end of the cam. This is a safety latch which prevents the sudden release of the line tension in the event of failure of power necessary to engage the clutch.

The foregoing arrangement attends to the transmission engagement, and prevents impermissible release of the line. It is also important that the motor not be operated unless the transmission is engaged. For this purpose, sensing switch 112 is provided. It has a follower 113 which follows a cam edge 114 on plate 108. It will be seen that it will change its switching condition when the cam follower has been withdrawn as the consequence of energizing solenoid 111. This is because such energizing rotates actuator arm 110 and moves it to the left in FIG. 1. Edge 114 dips, and its lower profile will pass under follower 113 about the time when follower 107 reaches edge 103. Then switch 112 enables the motor to operate. It may be in series with the primary motor control switch, or may be a pilot for an enabling relay, as preferred. Now, motor operation is enabled so long as either (1) tension remains in the line, or (2) the solenoid remains energized.

However, it is not best practice for a solenoid always to be operated at full current, and in this device it is not necessary that full current be applied to it after follower 107 starts to track on edge 103. Therefore a sensing switch 120 is provided with an actuator leaf 121 which contacts an extension 122 on plate 48. The actuator 121 of switch 120 is therefore responsive to whether the clutch is engaged or not. When it is, switch 120 is in one switching condition. When it is not, it is in another. For example, the conditions may be "on" and "off". The effect of this switch is to connect in series with the solenoid a large resistance 123*a* (FIG. 4) to reduce the current to the solenoid while the clutch is engaged. When the clutch is disengaged, this resistance will be switched out, and full current can be applied to the solenoid.

In the event of power failure while tension is on the line, it is necessary to reduce the tension at a controlled and proper rate. Abrupt release is undesirable. For this purpose, switch 105 is sensitive to whether there is or is not tension, and its switching condition is determined by whether cam 100 contacts and depresses actuator 106 or not. By simple circuitry, should actuator 106 not be contacted by member 100, and power fails, a battery circuit 106*a* (FIG. 4) will be connected to the "pay-out" circuit to the motor, and this will run until tension is released, as sensed by contact of member 100 with actuator 106. A power sensor 106*b* (FIG. 4) is a relay which closes when power is off to connect the battery to the power switch to provide the current to run the motor to release the tension. Switch 105 is also sensitive to the absence of tension in the line, and shuts off the motor when tension is off. The "switch-off" effect of switch 105 at zero tension is by passed when starting the program, or when passing through zero tension during a program by a shunt diode. (D-1) of the desired polarity to allow clockwise rotation of drum 32.

It will thereby be seen that the system is an elegantly simple, rugged and reliable one with means for the bi-directional driving of a motor, means for engaging or disengaging the motor so as to provide for free release of the line, means to prevent the free release of the line except under certain conditions, means to determine which way, if at all, the motor runs, and means to pay out the line in the event of power failure. The basic system has reliable checks and controls, and can broadly be programmed to carry out a wide range of preselected programs, and also undergo manual control, if desired. The motor may be a DC type motor which is self braking. In view of the gear reduction involved, it will not ordinarily require a separate brake. If desired, a brake can be supplied, especially if a strong enough pull on the line could overpower the un-energized motor.

It is also evident that alarm means may be provided. Voltage limiters and the like can be provided which respond to a line tension signal in excess of some predetermined maximum or minimum tension and give an audible or visual alarmm. Such a limitation may be set up by the maximum or minimum limiters. The actual force exerted can be read out by digital displays responsive to the signal derived from the tension sensing means. Timer responsive means may be provided to readout elapsed time or time remaining in a given course of treatment.

In order best to understand the program concepts and circuitry suitable for it, there are shown in FIGS. 5–10 a number of exemplary treatment cycles. The cycles of FIGS. 5–8 are those which can be expected to be put to most frequent use. There are also other useful cycles, for example those shown in FIGS. 9 and 10. The illustrated cycles should be adequate for an understanding of the invention, and to enable a therapist and programmer to program this device for other cycles. It is a feature of this invention that with the use of a suitable programming means, any type of sequence can be programmed.

In this specification, the term "dwell" means the period of time an attained tension is held either when going upwardly or going dowardly in tension in the forward course of the treatment. There are situations when there will be a time referred to as "pause" upon complete or partial relaxation depending on the course of the treatment. In all of the Figures, the ordinate is force, and the abscissa is time.

Figure 5:
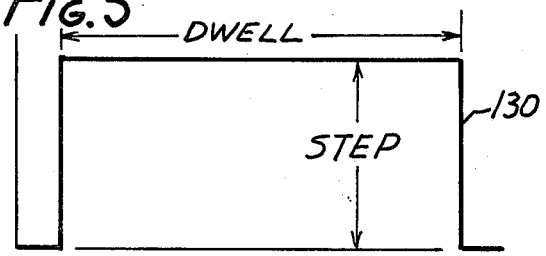
FIGS. 5–10 are schematic showings of representative traction force programs which this apparatus is able to conduct.

In FIG. 5 there is shown a single-step procedure starting from zero, going to a maximum value in a single step, dwelling at that point for a given period of time, and relaxing the tension to zero. This is shown by line 130.

Figure 6:
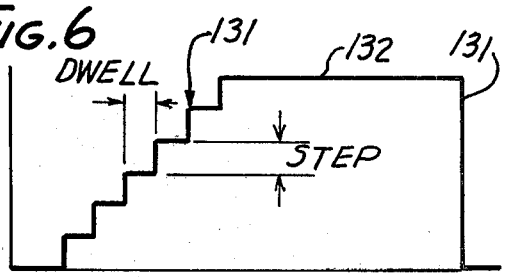

In FIG. 6 there is shown by line 131 a staircase function, wherein each step represents a new line tension increased from the last step by an incremental value called "step". This increased tension is held for a period of time called "dwell". This is a stepwise function of incremental increases and dwells followed by a holding period shown by segment 132 at the maximum load, followed by a reduction to zero.

Figure 7:
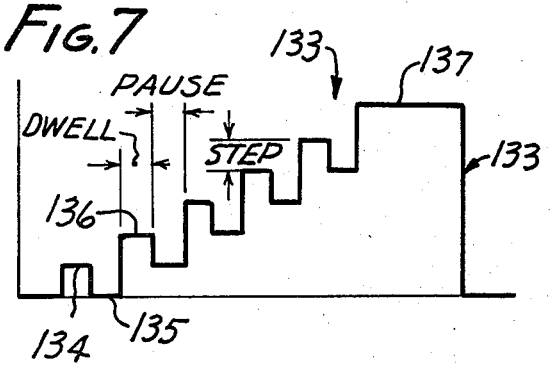

FIG. 7 shows by line 133 a different type of step function wherein the initially attained value, shown by segment 134, is released by an incremental value to a level shown by line 135. Then it is increased above the previously attained value as shown by line 136. The term "step" describes the differences between the two maxima, and the treatment relaxes each time to the maximum of the previous step. Finally some pre-determined maximum is arrived at as shown by segment 137, after which the force is released.

Figure 8:
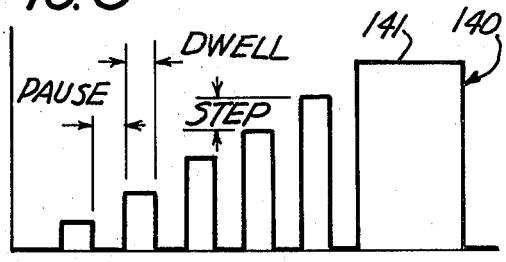

In FIG. 8 there is shown by line 140 another course of treatment, in which the tension in each successive cycle is increased above the one ahead of it by a given increment called a "step", and held for a period of time called "dwell", followed by reducting to zero and remaining at zero for a period of time called a "pause". After the desired maximum is reached as shown by line segment 141, then the force is released.

Figure 9:
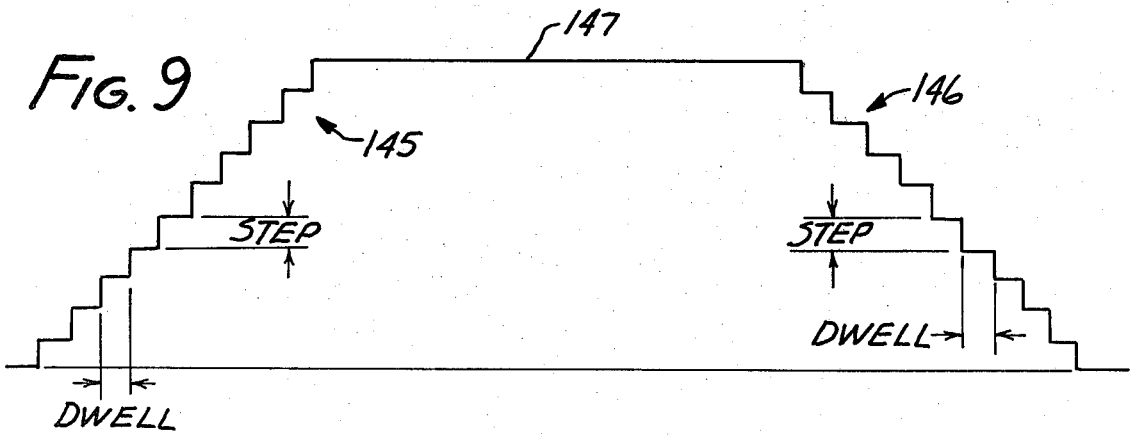

FIG. 9 shows that in addition to upwardly stepping patterns, the device can be programmed for reducing patterns from a maximum. FIG. 9 shows the concept of FIG. 6, but with two segments. A first segment 145 is an ascending segment shown in FIG. 6, and segment 146 is a descending segment; that is, the mirror image of the ascending segment. These segments are separated by an optional holding (or extended dwell) period shown by line segment 147.

Figure 10:
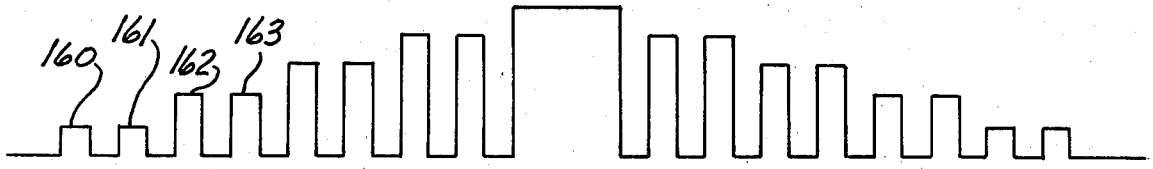

FIG. 10 shows that individual parts of a cycle may be repeated any number of times within a single major cycle. For example, segments 160 and 161 are identical, and segments 162 and 163 are also identical to one another. It will be noted that this is the pattern of FIG. 8, with duplicated cycles in the upward direction, and similar to the concept of FIG. 9 with a decreasing pattern also. It will be evident to persons skilled in the art that programming means can readily be devised to provide these and other desired combinations of sequences simply by determining the high and low portions of tension increase and descrease in each step, the length and time of dwell and pause if any, and whether the steps are increasing or decreasing. The sequences may be hardwired in programs if desired, and selected one-by-one by circuit cards, or may be provided in mirco-processor format, the details of which are unimportant to this invention because they can be divised by any skilled programmer.

Figure 4:
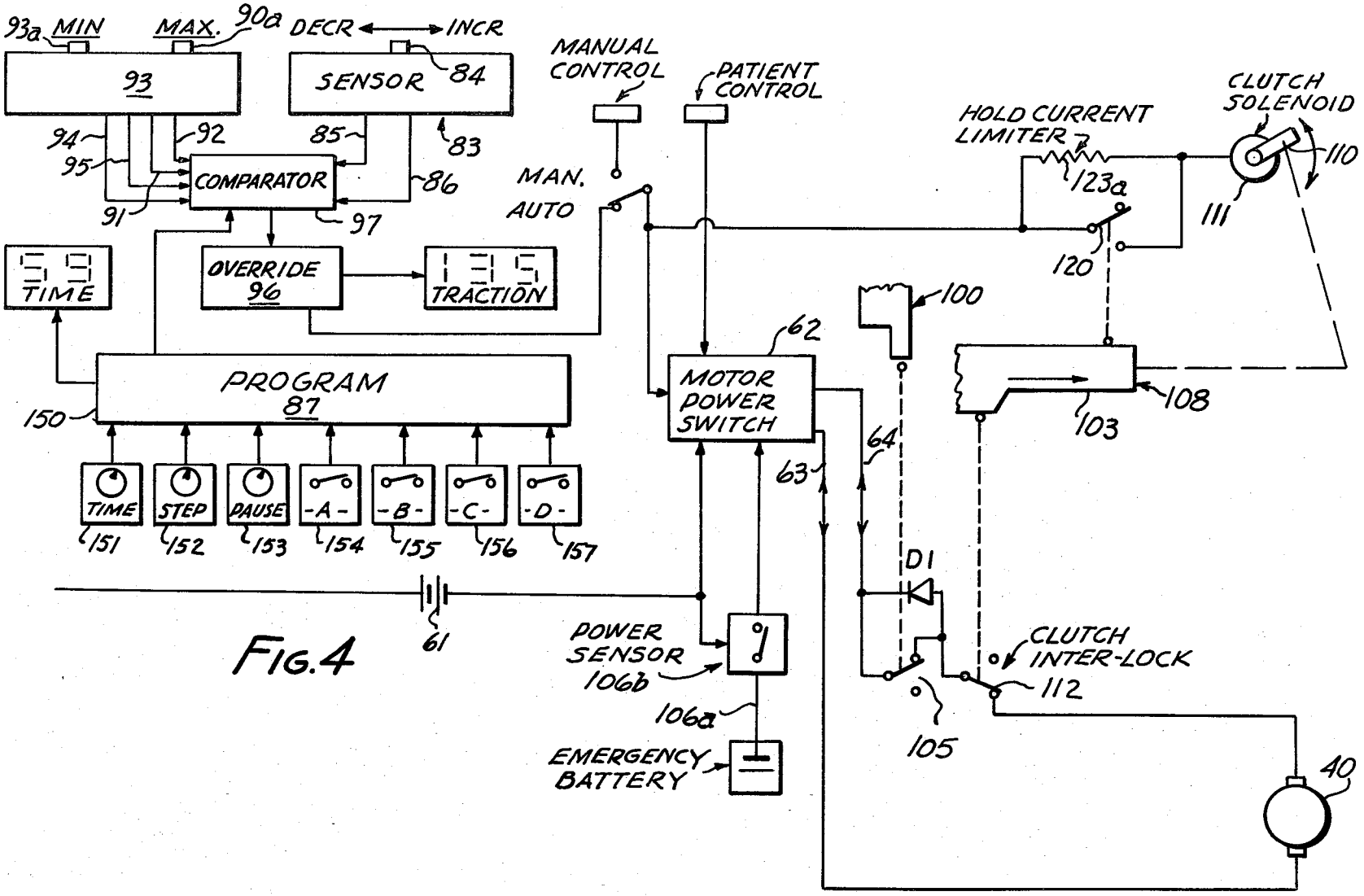
FIG. 4 is a system drawing showing circuitry and circuit logic concepts for use in this invention.

FIG. 4 shows the position of a micro-processor 150 used to carry out a selected program. The details of a suitable microprocessor, or of the programming of one, are arbitrary, and need no disclosure here. Such programmed micro-processors are readily obtained from persons skilled in that art. Also, it is possible to provide individual, selectible and replaceable circuit cards for programming if desired. What is necessary to understand is that the program means will start the system in operation, be programmed for each step, recognize when the programmed tension is achieved, dwell or pause as required, and go on to the next step, or stop. Total times, step and pause durations, and the like may also be selected, as schematically shown at 151, 152, 153. Four selectible programs are suggested at 154, 155, 156 and 157. They could be any of the illustrated programs of FIGS. 5–10, or any others, as desired.

Thus, the programming means will include definition means defining desired tension values sequentially to be attained, sequence means for referring sequentially to these values, and comparator means for comparing signals respective to the desired values and the actually attained values to operate the motor so as to make the attained value the same as the desired value.

FIG. 4 further shows the comparison of achieved and programmed tension, the enabling of clutch solenoid energizing, of motor operations, and of the various interlocks and controls. The "patient control" is simply an override circuit to pay-out the line and relieve the tensions. Manual control enables all steps to be done manually, and includes a bi-directional switch or relay means directly to control switch 62.

This system operates very quietly. The only noise is the initial engagement of the clutch, which can be muffled, and the running of the motor, which is slow and quiet. Accordingly, this system provides a reliable, quiet, and widely applicable traction device which is safe, fully programmable, and broadly useful.

While the programming is most advantageously accomplished with a micro-processor, such a program or control is not a limitation on the scope of the invention. This invention contemplates the use of any technique wherein a desired tension value is stipulated, and in which the attained tension is known and compared to it. The illustrated tension sensing means is an elegant, accurate and reliable means for reading out the attained tension, but its precise construction is not a limitation on this feature, either.

This invention is not to be limited by the embodiments shown in the drawings and described in the description which are given by way of example and not of limitation, but only in accordance with the scope of the appended claims.

I claim:

1. Apparatus for exerting traction force in traction therapy, said apparatus comprising;

a flexible line by means of which said force is to be exerted;

drive means to which said line is engaged for pulling in and paying out said line;

a motor operatively engaged to said drive means;

motor control means operatively interposed between said motor and a source of energy for driving said motor, said motor control means having a first and a second control condition for respectively causing said motor to pull in or to pay out said line, and a third control condition where it does neither;

tension sensing means responsive to tension exerted on said line and adapted to provide a signal which is proportional to the value of said tension;

program means comprising circuitry defining a predetermined sequence of motor operations to establish a predetermined sequence of tension values on said line, said program means being operationally coupled to said tension sensing means and to said motor control means to cause said motor control means sequentially to assume appropriate ones of its control conditions so as to attain said predetermined sequence of tension values in said line;

and transmission means including a clutch interposed between said motor and said drive means, and a cam and a cam follower interposed between said clutch and said tension sensing means, said cam and cam follower being so constructed and arranged as to hold said clutch engaged when there is tension in said flexible line above some minimum value.

2. Apparatus according to claim 1 in which said cam is moved by said tension sensing means, and in which said follower is moved by solenoid means actuable to engage said clutch, said follower being movable by said solenoid to clear said cam, whereafter, de-energizing said solenoid while tension is on said line, causes interference of said follower and cam and prevents disengagement of said clutch.

3. Apparatus according to claim 2 in which said clutch comprises a movable support plate, and an intermediate gear rotatably mounted to said support plate, adapted to interlink said motor and said drive means when said solenoid is energized.

4. Apparatus according to claim 3 in which said circuitry in said program means includes definition means defining desired tension values sequentially to be obtained in said sequence, sequence means for referring sequentially to said value in said definition means, and in which said motor control means includes comparator means for comparing the signal from said tension sensing means to a signal representative of a value selected by said sequence means, said motor control means assuming in response a respective condition which causes the motor to operate or not to operate to attain said selected value.

5. Apparatus according to claim 2 in which said circuitry in said program means includes definition means defining desired tension values sequentially to be obtained in said sequence sequence means for referring sequentially to said values in said definition means, and in which said motor control means includes comparator means for comparing the signal from said tension sensing means to a signal representative of a value selected by said sequence means, said motor control means assuming in response a respective condition which causes the motor to operate or not to operate to attain said selected value.

6. Apparatus according to claim 1 in which said follower includes second cam means, and in which a motor-enabling switch is responsive to said second cam means to enable motor operation only when said clutch is engaged.

7. Apparatus according to claim 6 in which said circuitry in said program means includes definition means defining desired tension values sequentially to be obtained in said sequence, sequence means for referring sequentially to said values in said definition means, and in which said motor control means includes comparator means for comparing the signal from said tension sensing means to a signal representative of a value selected by said sequence means, said motor control means assuming in response a respective condition which causes the motor to operate or not to operate to attain said selected value.

8. Apparatus according to claim 1 in which said cam is engageable with a switch mounted to said frame one of whose switching conditions is caused by cam contact at zero tension values, and another is caused by no contact at positive tension values, and an emergency power source connectible to said motor to drive the same in said last named other switching condition, when enabled by the failure of power, whereby the consequence of concomitant tension on said line and power failure causes said emergency power source to drive said motor to pay out said line to zero tension value.

9. Apparatus according to claim 8 in which said circuitry in said program means includes definition means defining desired tension values sequentially to be obtained in said sequence, sequence means for referring sequentially to said values in said definition means, and in which said motor control means includes comparator means for comparing the signal from said tension sensing means to a signal representative of a value selected by said sequence means, said motor control means assuming in response a respective condition which causes the motor to operate or not to operate to attain said selected value.

10. Apparatus according to claim 1 in which said tension sensing means comprises a spring having one of its ends anchored to said frame, means directing said line relative to the other end of said spring so that tension in said line determines the deflection of the spring, and a circuit element having a portion linked to said spring which portion moves as the deflection of the spring changes, said circuit element having a continuously variable parameter which thereby varies as a function of deflection of said spring.

11. Apparatus according to claim 10 in which said circuitry in said program means includes definition means defining desired tension values sequentially to be obtained in said sequence, sequence means for referring sequentially to said values in said definition means, and in which said motor control means includes comparator means for comparing the signal from said tension sensing means to a signal representative of a value selected by said sequence means, said motor control means assuming in response a respective condition which causes the motor to operate or not to operate to attain said selected value.

12. Apparatus according to claim 11 in which said circuitry in said program means includes definition means defining desired tension values sequentially to be obtained in said sequence, sequence means for referring sequentially to said values in said definition means, and in which said motor control means includes comparator means for comparing the signal from said tension sensing means to a signal representative of a value selected by said sequence means, said motor control means assuming in response a respective condition which causes the motor to operate or not to operate to attain said selected value.

13. Apparatus according to claim 10 in which said circuitry in said program means includes definition means defining desired tension values sequentially to be obtained in said sequence, sequence means for referring sequentially to said values in said definition means, and in which said motor control means includes comparator means for comparing the signal from said tension sensing means to a signal representative of a value selected by said sequence means, said motor control means assuming in response a respective condition which causes the motor to operate or not to operate to attain said selected value.

14. Apparatus according to claim 1 in which said circuitry in said program means includes definition means defining desired tension values sequentially to be obtained in said sequence, sequence means for referring sequentially to said values in said definition means, and in which said motor control means includes comparator means for comparing the signal from said tension sensing means to a signal representative of a value selected by said sequence means, said motor control means assuming in response a respective condition which causes the motor to operate or not to operate to attain said selected value.

15. Apparatus for exerting traction force in traction therapy, said apparatus comprising:

a flexible line by means of which said force is to be exerted;

drive means to which said line is engaged for pulling in and paying out said line;

a motor operatively engaged to said drive means;

motor control means operatively interposed between said motor and a source of energy for driving said motor, said motor control means having a first and a second control condition for respectively causing said motor to pull in or to pay out said line, and a third control condition where it does neither;

tension sensing means responsive to tension exerted on said line to provide a signal which is proportional to the value; and transmission means including a clutch interposed between said motor and said drive means, and a cam and a cam follower interposed between said clutch and said tension sensing means, said cam and cam follower being so constructed and arranged as to hold said clutch engaged when there is tension in said flexible line above some minimum value.

16. Apparatus according to claim 15 in which said cam is moved by said tension sensing means, and in which said follower is moved by solenoid means actuable to engage said clutch, said follower being movable by said solenoid to clear said cam, whereafter, de-energizing said solenoid while tension is on said line, causes interference of said follower and cam prevents disengagement of said clutch.

17. Apparatus according to claim 16 in which said clutch comprises a movable support plate, and an intermediate gear rotatably mounted to said support plate, adapted to interlink said motor and said drive means when said solenoid is energized.

18. Apparatus according to claim 15 in which said follower includes second cam means, and in which a motor-enabling switch is responsive to said second cam means to enable motor operation only when said clutch is engaged.

19. Apparatus according to claim 15 in which said cam is engageable with a switch mounted to said frame one of whose switching conditions is caused by cam contact at zero tension values, and another is caused by no contact at positive tension values, and an emergency power source connectible to said motor to drive the same in said last named other switching condition, when enabled by the failure of power, whereby the consequence of concomitant tension on said line and power failure causes said emergency power source to drive said motor to pay out said line to zero tension value.

20. Apparatus according to claim 15 in which said tension sensing means comprises a spring having one of its ends anchored to said frame, and means directing said line relative to the other end of said spring so that tension in said line determines the deflection of the spring.

* * * * *